US012233454B1

(12) United States Patent
Huang et al.

(10) Patent No.: US 12,233,454 B1
(45) Date of Patent: Feb. 25, 2025

(54) CASTING-ROLLING SIDE SEALING DEVICE WITH ELECTROMAGNETIC STIRRING FUNCTION

(71) Applicant: Taiyuan University of Science and Technology, Taiyuan (CN)

(72) Inventors: Zhiquan Huang, Taiyuan (CN); Jinchao Zou, Xinji Town (CN); Xiangyu Gao, Taiyuan (CN); Lianyun Jiang, Jining (CN); Lifeng Ma, Taiyuan (CN); Yanchun Zhu, Taiyuan (CN); Guofeng Cai, Yinchuan (CN); Miaomiao Zhang, Jincun Town (CN)

(73) Assignee: Taiyuan University of Science and Technology, Taiyuan (CN)

( * ) Notice: Subject to any disclaimer, the term of this patent is extended or adjusted under 35 U.S.C. 154(b) by 0 days.

(21) Appl. No.: 18/609,113

(22) Filed: Mar. 19, 2024

(30) Foreign Application Priority Data

Dec. 27, 2023 (CN) ..... 202311817305
Jan. 4, 2024 (CN) ..... 202410012984

(51) Int. Cl.
*B22D 11/115* (2006.01)
*B22D 11/06* (2006.01)

(52) U.S. Cl.
CPC ..... *B22D 11/115* (2013.01); *B22D 11/0622* (2013.01)

(58) Field of Classification Search
CPC .... B22D 11/06; B22D 11/0622; B22D 11/115
USPC ..... 164/147.1, 502, 504
See application file for complete search history.

(56) References Cited

FOREIGN PATENT DOCUMENTS

CN 2649221 Y * 10/2004 ..... B22D 11/06

OTHER PUBLICATIONS

Machine translation of CN 2649221 Y (Year: 2004).*

* cited by examiner

*Primary Examiner* — Kevin P Kerns
(74) *Attorney, Agent, or Firm* — Pilloff Passino & Cosenza LLP; Rachel K. Pilloff; Sean A. Passino

(57) ABSTRACT

A casting-rolling side sealing device with an electromagnetic stirring function is provided and includes a pair of side sealing plates covering two side ends of a casting-rolling zone from a casting-rolling starting end to a casting-rolling ending end respectively, a pre-tightening force is formed between one of the side sealing plates and adjacent casting rolls. A pulse end of a first electromagnetic assembly releases first pulses along a first axis direction parallel to a direction from the side ends to a center of the casting-rolling zone. The first pulses are configured to generate an electromagnetic stirring effect in the casting-rolling zone. A second electromagnetic assembly is arranged on each of the side sealing plates, a pulse end of the second electromagnetic assembly releases second pulses along a second axis direction perpendicular to the first axis direction.

9 Claims, 11 Drawing Sheets

CASTING-ROLLING SIDE SEALING DEVICE WITH ELECTROMAGNETIC STIRRING FUNCTION

CROSS-REFERENCE TO RELATED APPLICATIONS

This application claims priority to Chinese Patent Application No. 202311817305.7, filed on Dec. 27, 2023 and to Chinese Patent Application No. 202410012984.9, filed on Jan. 4, 2024, the contents of which are hereby incorporated by reference.

TECHNICAL FIELD

The disclosure belongs to the technical field of metal material processing, and in particular to a casting-rolling side sealing device with an electromagnetic stirring function.

BACKGROUND

As a light and high-strength metal structural material that may be commercialized at present, magnesium alloy has a great application demand in aerospace, automobile, rail transit and other fields, especially a wide magnesium alloy sheet and strip with a thickness of 0.5 mm-5 mm has a strongest demand in these fields and has become an important development direction of magnesium alloy industry at present.

Compared with traditional open-die hot continuous rolling, casting-rolling magnesium alloy has advantages such as short process, good formability and low cost. However, due to a small specific heat capacity and rapid heat dissipation of magnesium alloy itself, a temperature drop in a three-way heat exchange area at an edge of a casting-rolling zone is faster than that in a two-way heat exchange area at a middle, which makes the edge solidify prematurely and produce boundary viscosity with a side sealing plate, resulting in a large tensile stress. Therefore, it is easy for a casting-rolling sheet to have damage defects such as uneven microstructures, segregation and edge cracks, which leads to its unstable performance and restricts its large-scale application. At present, specific measures and devices for the edge cracks of magnesium alloy casting-rolling are not mature, so it is urgent to develop a shape/property coordinated control process and a device that may effectively control heat dissipation at the edge, inhibit boundary viscosity between the casting-rolling zone and the side sealing plate, and realize microstructure homogenization and grain refinement at the same time.

SUMMARY

An objective of the disclosure is to provide a casting-rolling side sealing device with an electromagnetic stirring function, so as to solve the above problems and achieve an objective of improving an effect of controlling a shape and property of a magnesium alloy casting-rolling zone.

In order to achieve the above objective, the disclosure provides a following scheme. A casting-rolling side sealing device with an electromagnetic stirring function is provided, which includes a casting-rolling zone formed by a rotational cooperation of at least one pair of casting rolls, and further includes:

a pair of side sealing plates configured to cover two side ends of the casting-rolling zone respectively from a casting-rolling starting end to a casting-rolling ending end, and a pre-tightening force is formed between any one of the side sealing plates and adjacent casting rolls;

a first electromagnetic assembly arranged on each of the side sealing plates, where a pulse end of the first electromagnetic assembly releases first pulses along a first axis direction parallel to a direction from the side ends to a center of the casting-rolling zone; the first pulses are configured to generate an electromagnetic stirring effect in the casting-rolling zone and promote a heat exchange in a microstructure and form a Joule heat effect; and a second electromagnetic assembly arranged on the each of the side sealing plates, where a pulse end of the second electromagnetic assembly releases second pulses along a second axis direction perpendicular to the first axis direction, and the second pulses are configured to act on a side edge of the casting-rolling zone to reduce viscous resistance formed by a contact between the each of the side sealing plates and an end face of a solidified microstructure in an adjacent casting-rolling zone.

Optionally, the first electromagnetic assembly includes:

a ceramic core, cooperatively fixed on a side, opposite to an other side contacting the casting rolls, of the each of the side sealing plates;

a first electromagnetic coil, wound around the ceramic core and configured to externally connect with a low-frequency pulse generator, where the first electromagnetic coil cooperates with the ceramic core to release the first pulses; and an adjusting piece, arranged on the each of the side sealing plates, where an adjusting end of the adjusting piece is configured to connect with the first electromagnetic coil, and capable of controlling a number of turns of the first electromagnetic coil connected with the low-frequency pulse generator to adjust a magnetic induction line density of the first pulses, so as to accurately control a pulse action end in a mechanical level.

Optionally, the adjusting piece includes:

a carbon brush, where a groove is formed on one side of the ceramic core close to the casting-rolling starting end, and the carbon brush is slidably fitted in the groove and in sliding contact with the first electromagnetic coil, and one end of the first electromagnetic coil close to the casting rolls is directly connected with the low-frequency pulse generator, and an other end of the first electromagnetic coil is connected with the low-frequency pulse generator through the carbon brush; and a driving mechanism, arranged on the each of the side sealing plates, where a driving end of the driving mechanism is connected with the carbon brush, and the carbon brush is slidably fitted in the groove through the driving mechanism.

Optionally, the driving mechanism includes:

a stepping motor fixedly connected to the ceramic core, where an output shaft of the stepping motor is connected with a transmission tooth section of a screw through a gear pair, and the screw is fixed in the groove through a bearing, and the carbon brush is in threaded fit with the screw.

Optionally, the second electromagnetic assembly includes:

a silicon steel piece fixed on one side, away from the casting rolls, of the each of the side sealing plates; and second electromagnetic coils wound on the silicon steel piece, and one end of the second electromagnetic coils is externally connected with a high-voltage high-frequency pulse generator, where the second electromagnetic coils cooperate with the silicon steel piece to release the second pulses.

Optionally, the silicon steel piece has a U-shaped structure, and the second electromagnetic coil is symmetrically wound around two arms of the silicon steel piece, and a magnetic pole end face of the silicon steel piece is correspondingly placed at a side end face of the casting-rolling zone to ensure that a magnetic pole connection line is parallel to the side end face of the casting-rolling zone in a vertical direction.

Optionally, the second axis direction is perpendicular to the first axis direction.

Optionally, one side, away from the casting rolls, of the each of the side sealing plates is fixedly connected with a sealing shell, and the first electromagnetic assembly, the second electromagnetic assembly and the adjusting piece are all arranged in the sealing shell, where a heat insulation plate is arranged between the each of the side sealing plates and the sealing shell.

Optionally, the sealing shell includes:

a supporting housing, fixedly connected to the side, away from the casting rolls, of the each of the side sealing plates, where an area of a side end face of the casting-rolling zone is smaller than a projected area of an inner cavity of the supporting housing on the adjacent casting rolls;

a first casting-rolling sealing plate fixedly connected to one side, close to the each of the side sealing plates, of the supporting housing, where the heat insulation plate is fixedly connected between the first casting-rolling sealing plate and the each of the side sealing plates; and a second casting-rolling sealing plate fixedly connected to one side, away from the casting rolls, of the supporting housing.

Optionally, one side, close to the casting-rolling zone, of the first casting-rolling sealing plate is provided with a caulking groove.

Compared with the prior art, the embodiment has following advantages and technical effects.

According to the disclosure, the first electromagnetic assembly is arranged on the each of the side sealing plates, so that the pulse end of the first electromagnetic assembly releases the first pulses along the first axis direction, and an induced electromagnetic field is formed at a side end interface position of the casting-rolling zone, and then an induced current is generated in a direction from a side end interface region to the center of the casting-rolling zone. The electromagnetic stirring is used to promote a thermal cycle, and the Joule heat effect is generated to heat a solidification zone at the edge of the casting-rolling zone to make up for a heat loss caused by a rapid heat exchange at the edge. Moreover, an electromagnetic field targeting effect generated under an action of the first pulses may make an edge region and a middle of the casting-rolling zone form a circulating heat exchange, thereby reducing a situation that a large edge tensile stress is generated due to a temperature difference between the edge and the center, resulting in an uneven microstructure and forming defects such as microstructure segregation and edge cracks. In addition, during the heat exchange, crystals formed earlier at the edge fall off and nucleate at the same time with the middle region, so as to realize secondary nucleation of the crystals and promote grain refinement. The second electromagnetic assembly is also arranged on the each of the side sealing plates, and the second electromagnetic assembly generates the second pulses intersecting with the first pulses. Under an action of the second pulses, a repulsive action is formed between the each of the side sealing plates and an adjacent solidified microstructure through a Lorentz force. A fuzzy contact is formed between the solidified microstructure and the each of the side sealing plates by the repulsive force, which further reduces an edge viscous effect between the solidified microstructure and the each of the side sealing plates, and enhances a effect of controlling a shape and property on a magnesium alloy casting-rolling sheet.

BRIEF DESCRIPTION OF THE DRAWINGS

In order to explain technical schemes of the present disclosure or technical schemes in the prior art more clearly, drawings needed in embodiments are briefly introduced below. Apparently, the drawings in a following description are only some embodiments of the present disclosure. For a person of ordinary skill in the art, other drawings may be obtained according to these drawings without paying a creative labor.

DETAILED DESCRIPTION OF THE EMBODIMENTS

Figure 1:
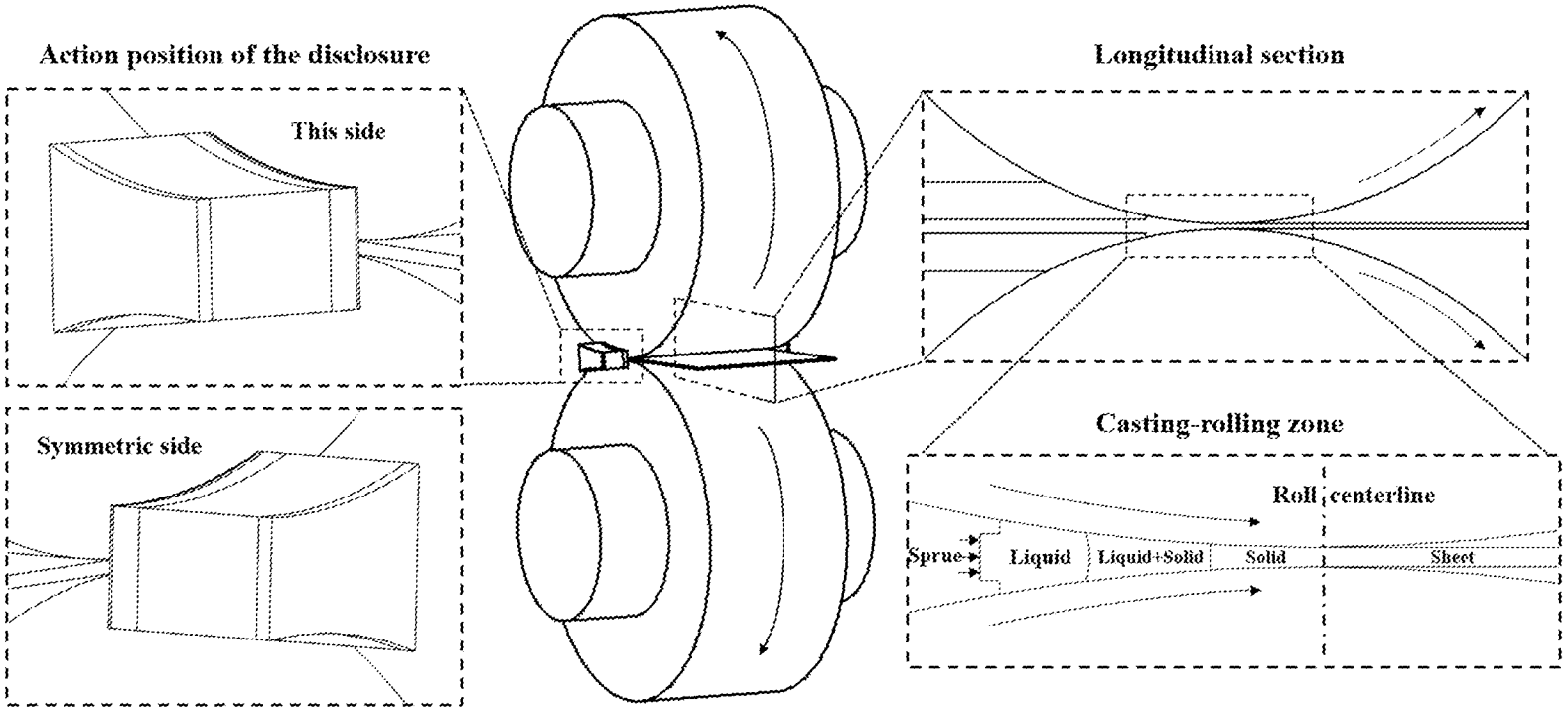
FIG. 1 is a schematic diagram of an action position and a casting-rolling process according to the disclosure.
Figure 2:
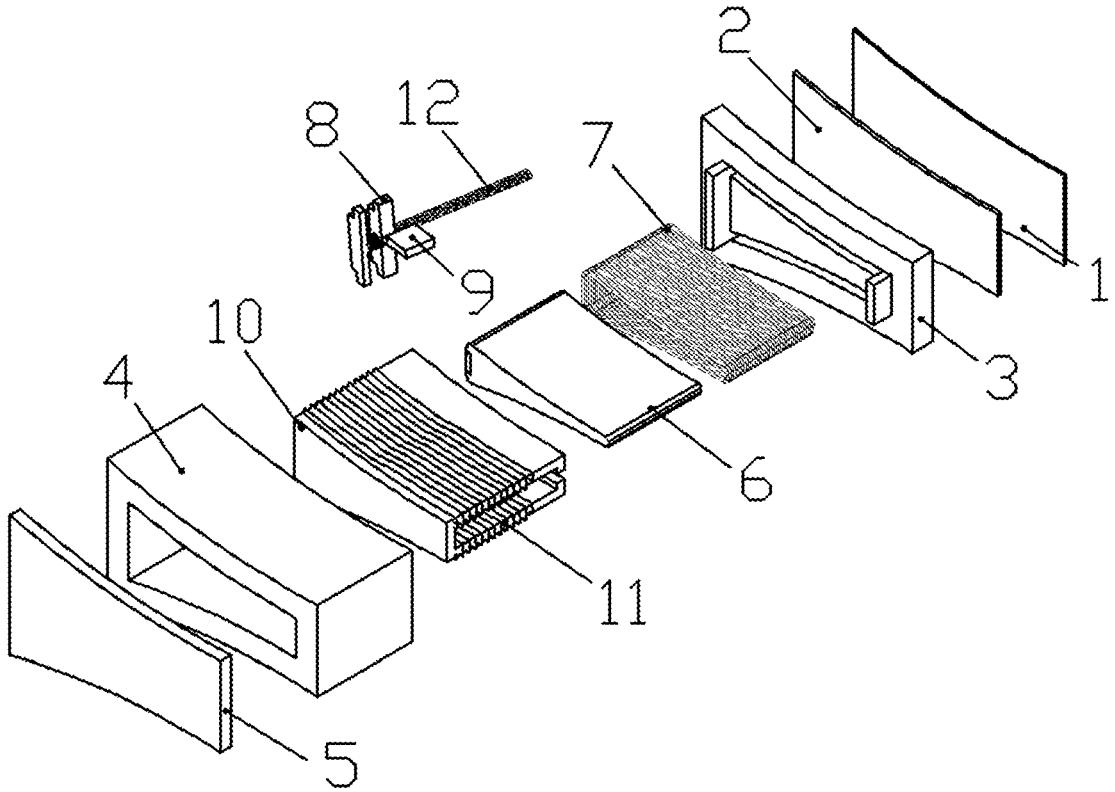
FIG. 2 is a schematic diagram of isometric explosion according to the disclosure.
Figure 3:
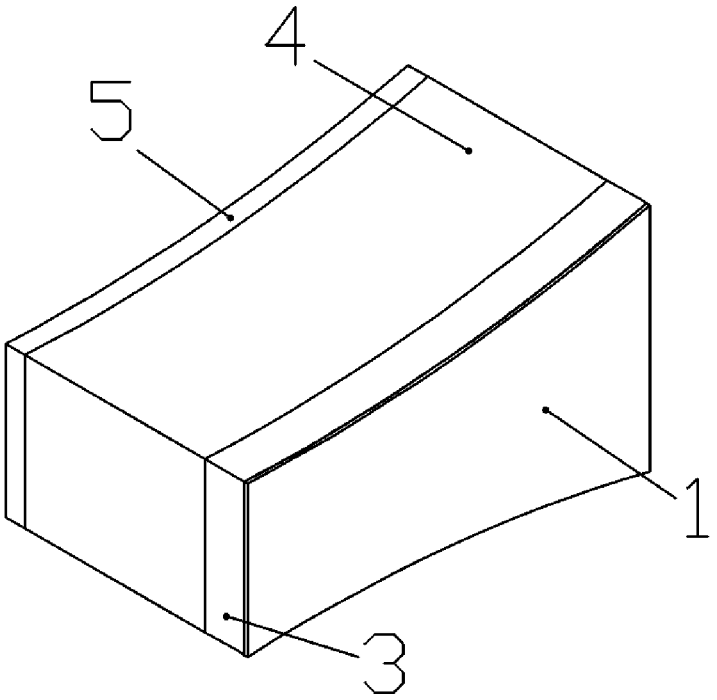
FIG. 3 is an isometric diagram of a supporting housing and a side sealing plate.
Figure 4:
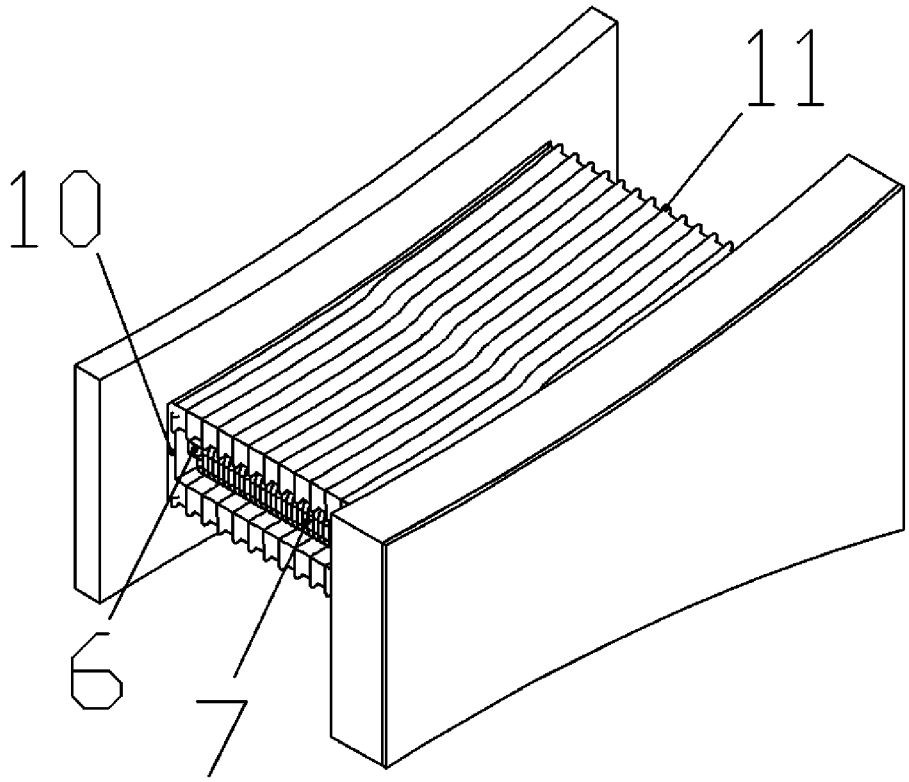
FIG. 4 is a diagram showing a positional relationship between second electromagnetic coils and a first electromagnetic coil.
Figure 5:
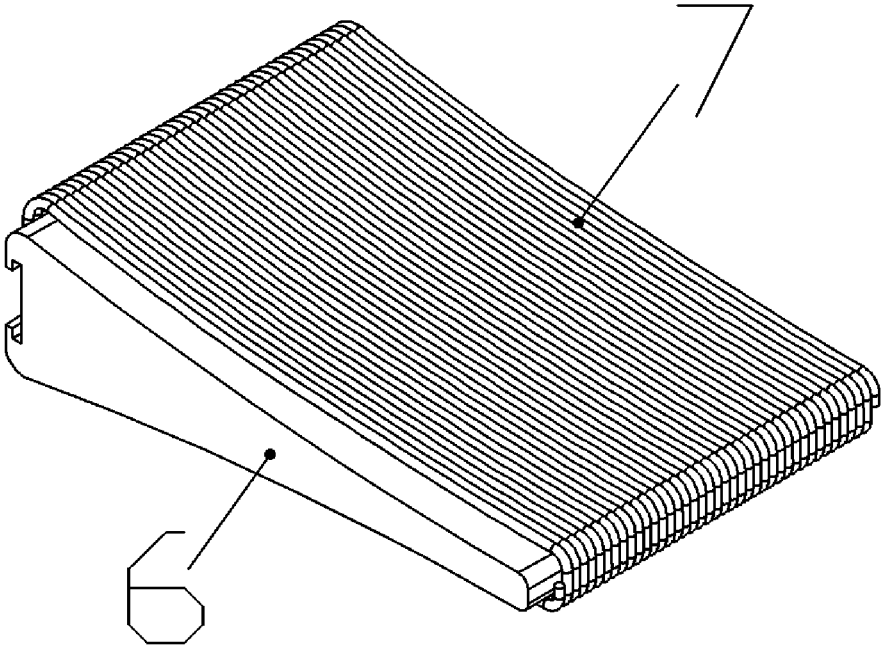
FIG. 5 is a schematic structural diagram of a ceramic core.
Figure 6:
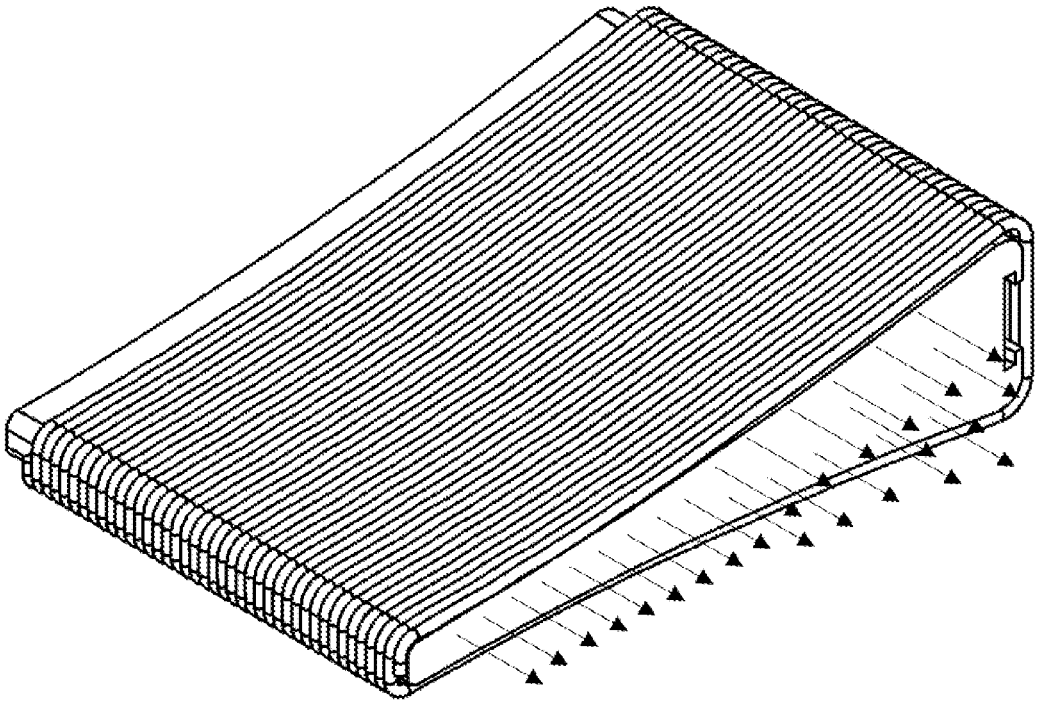
FIG. 6 is a schematic diagram of action lines of first pulses.
Figure 7:
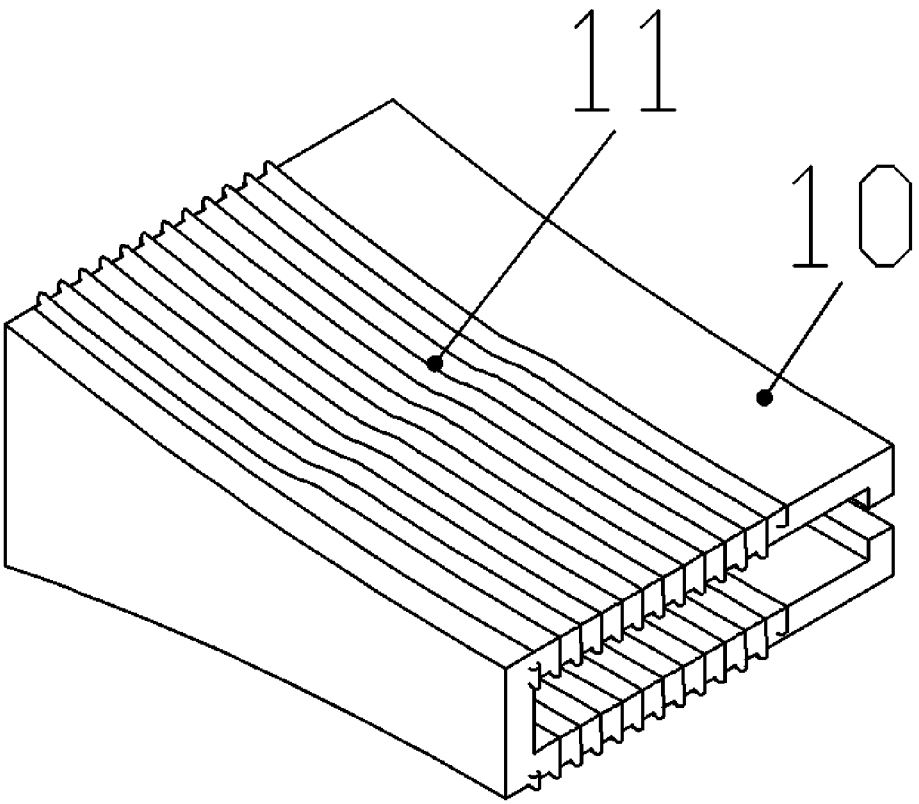
FIG. 7 is a schematic structural diagram of a silicon steel piece.
Figure 8:
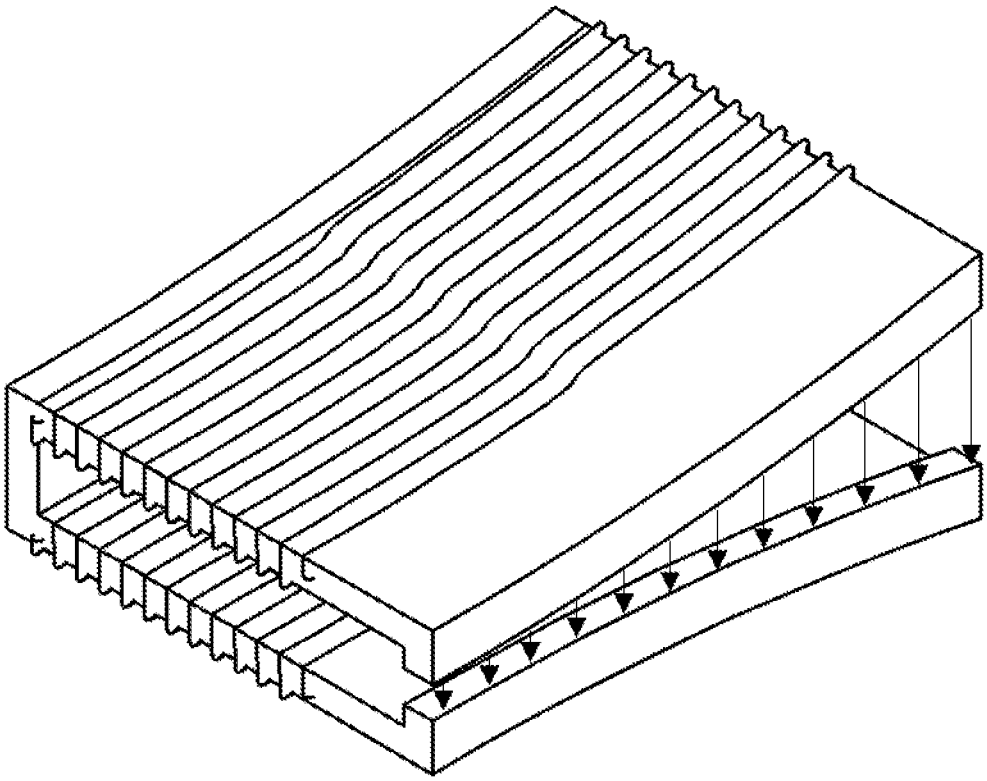
FIG. 8 is a schematic diagram of action lines of second pulses.
Figure 9:
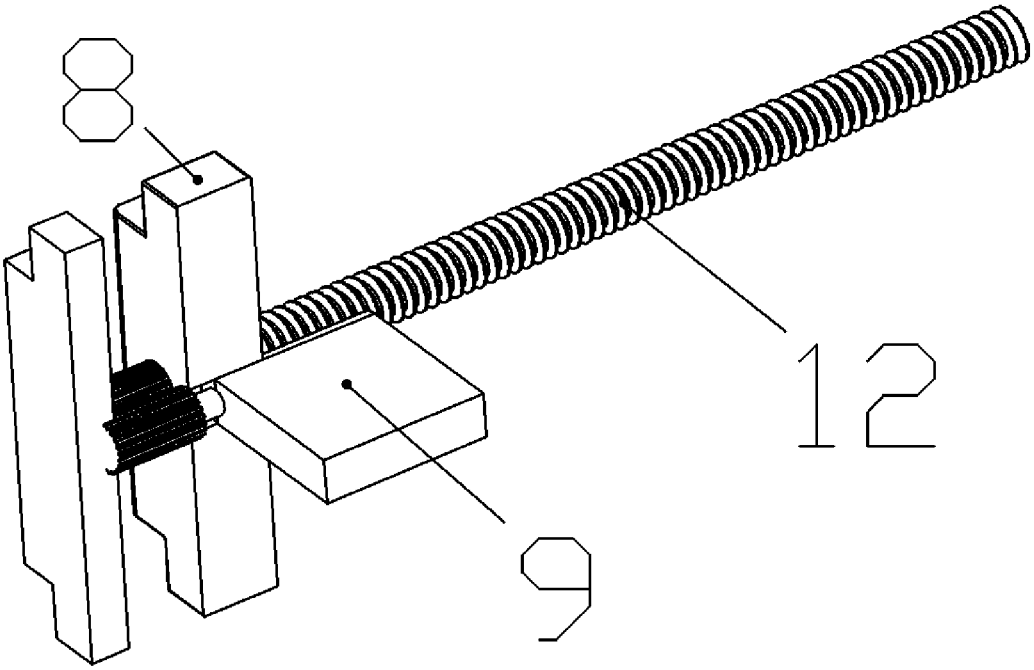
FIG. 9 is a structural schematic diagram of an adjusting piece.

In the following, technical schemes in embodiments of the disclosure may be clearly and completely described with reference to attached drawings in embodiments of the disclosure. Apparently, the described embodiments are only a part of the embodiments of the disclosure, but not all embodiments. Based on the embodiments in the disclosure, all other embodiments obtained by a person of ordinary skill in the art without a creative efforts belong to a scope of protection of the disclosure.

In order to make above objects, features and advantages of the disclosure more apparent and easier to understand, the disclosure may be further described in detail with the attached drawings and specific embodiments.

Embodiment: with reference to FIGS. 1-11, a casting-rolling side sealing device with an electromagnetic stirring function is provided, which includes a casting-rolling zone formed by rotational cooperation of at least one pair of casting rolls, and further includes:

a pair of side sealing plates 1 configured to cover two side ends of the casting-rolling zone respectively from a casting-rolling starting end to a casting-rolling ending end, and a pre-tightening force is formed between any one of the side sealing plates 1 and adjacent casting rolls;

a first electromagnetic assembly arranged on each of the side sealing plates 1, where a pulse end of the first electromagnetic assembly releases first pulses along a first axis direction parallel to a direction from the side ends to a center of the casting-rolling zone; and the first pulses are configured to generate an electromagnetic stirring effect in the casting-rolling zone, and promote a heat exchange in a microstructure and form a Joule heat effect at the same time; and a second electromagnetic assembly arranged on the each of the side sealing plates 1, where a pulse end of the second electromagnetic assembly releases second pulses along a second axis direction perpendicular to the first axis direction, and the second pulses are configured to act on a side edge of the casting-rolling zone to reduce viscous resistance formed by a contact between the each of the side sealing plates 1 and an end face of a solidified microstructure in an adjacent casting-rolling zone.

According to the disclosure, the pair of side sealing plates 1 are respectively arranged at the two sides of the casting-rolling zone to block the casting-rolling zone from the casting-rolling starting end to the casting-rolling ending end, so that a sealing effect on the casting-rolling zone is improved by using the side sealing plates 1 to apply a pre-tightening force to roll casting. The first electromagnetic assembly is arranged on the each of the side sealing plates 1, so that the pulse end of the first electromagnetic assembly releases the first pulses along the first axis direction, and an induced electromagnetic field is formed at a side end interface position of the casting-rolling zone, and then an induced current is generated in a direction from a side end interface region to the center of the casting-rolling zone. The electromagnetic stirring is used to promote a thermal cycle, and the Joule heat effect is generated to heat casting-rolling melts at the edge of the casting-rolling zone to make up for a heat loss caused by a rapid heat exchange at the edge. Moreover, an electromagnetic field targeting effect generated under an action of the first pulses may make an edge region and a middle of the casting-rolling zone form a circulating heat exchange, thereby reducing a situation that a large edge tensile stress is generated due to a temperature difference between the edge and the middle, resulting in an uneven microstructure and forming defects such as microstructure segregation and edge cracks. In addition, during the heat exchange, uniform distribution of heat may make crystals formed earlier at the edge fall off and nucleate at the same time with the middle region, so as to realize secondary nucleation of the crystals and promote grain refinement. The second electromagnetic assembly is also arranged on the each of the side sealing plates 1, and the second electromagnetic assembly generates the second pulses intersecting with the first pulses. Under an action of the second pulses, a repulsive action is formed between the each of the side sealing plates 1 and an adjacent solidified microstructure through a Lorentz force. A fuzzy contact is formed between the solidified microstructure and the each of the side sealing plates 1 by the repulsive force, which further reduces an edge viscous effect between the solidified microstructure and the each of the side sealing plates 1, and enhances a effect of controlling a shape and property on a magnesium alloy casting-rolling sheet.

It is understandable that, the pre-tightening force acts on the side sealing plates 1 to make the side sealing plates 1 adhere to the adjacent casting rolls. The pre-tightening force may be fixed by an external hydraulic drive device or welding and casting the side sealing plates 1 with a support mechanism, so as to limit and fix the side sealing plates 1 on side end faces of the casting rolls. Moreover, the pre-tightening force meets: the pre-tightening force=a pouring pressure at a gate in the casting-rolling zone+a reaction force of the casting rolls to the side sealing plates 1+a lateral component of a casting roll force along an axial direction of the casting rolls.

Figure 11:
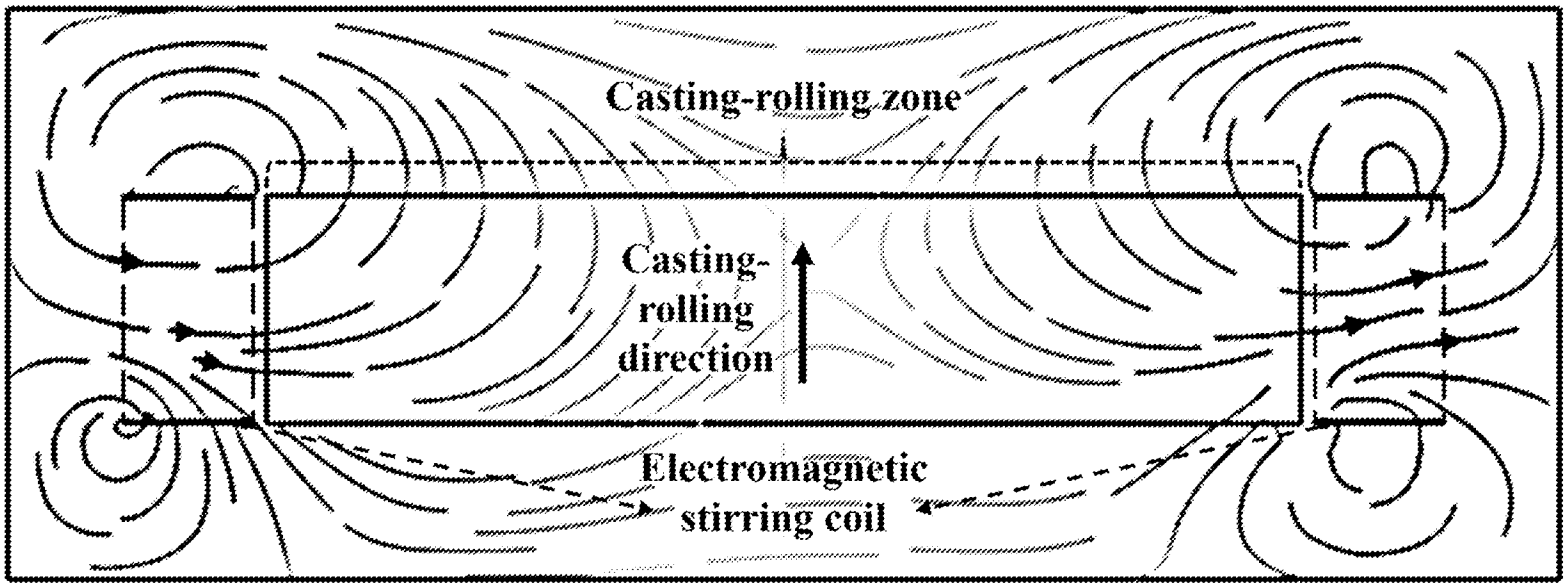
FIG. 11 is a schematic diagram of action lines of an electromagnetic field formed by first pulses.

With reference to FIG. 11, the first pulses at both sides of the casting-rolling zone are in a same direction. Because electromagnetic field forces are generated in the casting-rolling zone when the first pulses are released along the first axis direction, a center repulsive force will be generated in the center of the casting-rolling zone when directions of the electromagnetic field forces on the both sides are opposite, so the first pulses on the both sides of the casting-rolling zone may be released in the same direction by controlling a current direction.

In an embodiment, the first electromagnetic assembly includes:

a ceramic core 6 cooperatively fixed on a side of the side sealing plate 1 opposite to an other side contacting the casting rolls;

a first electromagnetic coil 7 wound around the ceramic core 6 and configured to externally connect with a low-frequency pulse generator, where the first electromagnetic coil 7 cooperates with the ceramic core 6 to release the first pulses; and an adjusting piece arranged on the side sealing plate 1, where an adjusting end of the adjusting piece is configured to connect with the first electromagnetic coil 7, and capable of controlling a number of turns of the first electromagnetic coil 7 connected with the low-frequency pulse generator to adjust a magnetic induction line density of the first pulses, thereby accurately controlling a pulse action end in a mechanical level.

The first electromagnetic coil 7 wound around the ceramic core 6 is used and connected with the low-frequency pulse generator to form the first pulses, thereby realizing an electromagnetic field action on the casting-rolling zone. The adjusting piece is also arranged relative to the first electromagnetic coil 7 and connected with the first electromagnetic coil 7 through the adjusting end. The number of turns of the first electromagnetic coil 7 connected with the low-frequency pulse generator is controlled by the adjusting piece, thereby realizing an adjustment of the magnetic induction line density of the first pulses, realizing a secondary control of an electromagnetic field intensity and targeted concentration in the casting-rolling zone, and further improving the effect of controlling the shape and properties in the casting-rolling zone. By connecting the first electromagnetic coil 7 with the low-frequency pulse generator, a direction control of the first pulses on the both sides of the casting-rolling zone is realized by using the low-frequency pulse generator to control the current direction.

In an embodiment, the adjusting piece includes:

a carbon brush 8, where a groove is formed on one side of the ceramic core 6 close to the casting-rolling starting end, and the carbon brush 8 is slidably fitted in the groove and in sliding contact with the first electromagnetic coil 7, and one end of the first electromagnetic coil 7 close to the casting rolls is directly connected with the low-frequency pulse generator, and an other end of the first electromagnetic coil 7 is connected with the low-frequency pulse generator through the carbon brush 8; and a driving mechanism arranged on the side sealing plate 1, where a driving end of the driving mechanism is connected with the carbon brush 8, and the carbon brush 8 is slidably fitted in the groove through the driving mechanism.

In an embodiment, the driving mechanism includes:

a stepping motor 9 fixedly connected to the ceramic core 6, where an output shaft of the stepping motor 9 is connected with a transmission tooth section of a screw 12 through a gear pair, and the screw 12 is fixed in the groove through a bearing, and the carbon brush 8 is threadedly fitted with the screw 12.

The ceramic core 6 is provided with the groove. It is understandable that the first electromagnetic coil 7 and the low-frequency pulse generator form a loop connection. The end of the first electromagnetic coil 7, close to the casting rolls, is directly connected with the low-frequency pulse generator, and the other end is connected with the low-frequency pulse generator through the carbon brush 8, so that a physical control of a number of connecting turns between the first electromagnetic coil 7 and the low-frequency pulse generator is realized according to a conductive effect of the carbon brush 8. The stepping motor 9 rotates the screw 12 through a gear set, and the screw 12 is threadedly connected with the carbon brush 8, which drives the carbon brush 8 to slide in the groove in a limited way. Correspondingly, the part of the first electromagnetic coil 7 located in the groove may be directly connected with the carbon brush 8 in a conductive manner.

In an embodiment, the second electromagnetic assembly includes:

a silicon steel piece 10 fixed on one side of the side sealing plate 1 away from the casting rolls; and second electromagnetic coils 11 wound on the silicon steel piece 10, and one end of the second electromagnetic coils 11 is externally connected with a high-voltage high-frequency pulse generator, where the second electromagnetic coils 11 cooperate with the silicon steel piece 10 to release the second pulses.

The silicon steel piece 10 is fixedly arranged on the side sealing plate 1, and the second electromagnetic coils 11 wound around the silicon steel piece 10 is connected with the high-voltage high-frequency pulse generator, so that the second pulses are released in the second axial direction. The second pulse direction intersects with the first pulse direction, and a Lorentz repulsive force from the side sealing plate 1 to the edge of the solidified microstructure is formed by the second pulses, so that the fuzzy contact is formed between the side sealing plate 1 and the solidified microstructure, and viscosity of the edge of the solidified microstructure is reduced.

In an embodiment, the silicon steel piece 10 has a U-shaped structure, and the second electromagnetic coils 11 are symmetrically wound around two arms of the silicon steel piece 10, and a notch direction of the silicon steel piece 10 faces the casting-rolling zone.

In an embodiment, the second axis direction is perpendicular to the first axis direction.

The silicon steel piece 10 is U-shaped, and the second electromagnetic coils 11 are symmetrically wound around the two arms of the silicon steel piece 10, so that the second pulse direction acts on one arm along the other arm, forming a second pulse action perpendicular to the first axis direction and parallel to side wall surfaces of the casting-rolling zone. It is understandable that, at this time, electromagnetism acts on the edge of the casting-rolling zone, and the Lorentz force with a strong magnetic field effect is generated, and a corresponding effect of blocking the solidified microstructure from sticking to the side sealing plates 1 is the best.

In an embodiment, the side of the side sealing plate 1 away from the casting rolls is fixedly connected with a sealing shell, and the first electromagnetic assembly, the second electromagnetic assembly and the adjusting piece are all arranged in the sealing shell, where a heat insulation plate 2 is arranged between the side sealing plate 1 and the sealing shell.

The sealing shell is used to cover all the assemblies, and the heat insulation plate 2 is arranged between the side sealing plate 1 and the sealing shell, which may not only provide insulation and protection to the sealing shell, but also play a heat preservation effect on the edge of the casting-rolling zone.

In an embodiment, the sealing shell includes:

a supporting housing 4 fixedly connected to the side of the side sealing plate 1 away from the casting rolls, and an area of the side end face of the casting-rolling zone is smaller than a projected area of an inner cavity of the supporting housing 4 on the adjacent casting rolls;

a proximal casting-rolling sealing plate 3 (i.e., first casting-rolling sealing plate) fixedly connected to one side of the supporting housing 4 close to the side sealing plate 1, and the heat insulation plate 2 is fixedly connected between the proximal casting-rolling sealing plate 3 and the side sealing plate 1; and a distal casting-rolling sealing plate 5 (i.e., second casting-rolling sealing plate) fixedly connected to one side of the supporting housing 4 away from the casting rolls.

In this technical scheme, the proximal casting-rolling sealing plate 3 and the distal casting-rolling sealing plate 5 cooperate to secure the silicon steel piece 10, and to improve sealability of a whole structure. In addition, the inner cavity formed by the sealing shell is adapted to a side end face structure of the casting-rolling zone, and a size of the inner cavity is larger than that of the side end face, so that the first pulses generated by the first electromagnetic assembly and the second pulses generated by the second electromagnetic assembly effectively act on the casting-rolling zone, an effect of improving shape control is guaranteed.

In an embodiment, the side of the proximal casting-rolling sealing plate 3 close to the casting-rolling zone is provided with a caulking groove, and the caulking groove penetrates both sides of the proximal casting-rolling sealing plate 3.

The caulking groove facilitates an installation and fixation of the ceramic core 6 and the silicon steel piece 10. Meanwhile, a magnetic pole end face of the silicon steel piece 10 is placed correspondingly to the side end face of the casting-rolling zone, so that the released first pulses and the released second pulses are correspondingly applied to the casting-rolling zone.

A working process of this embodiment is as follows.

Figure 10:
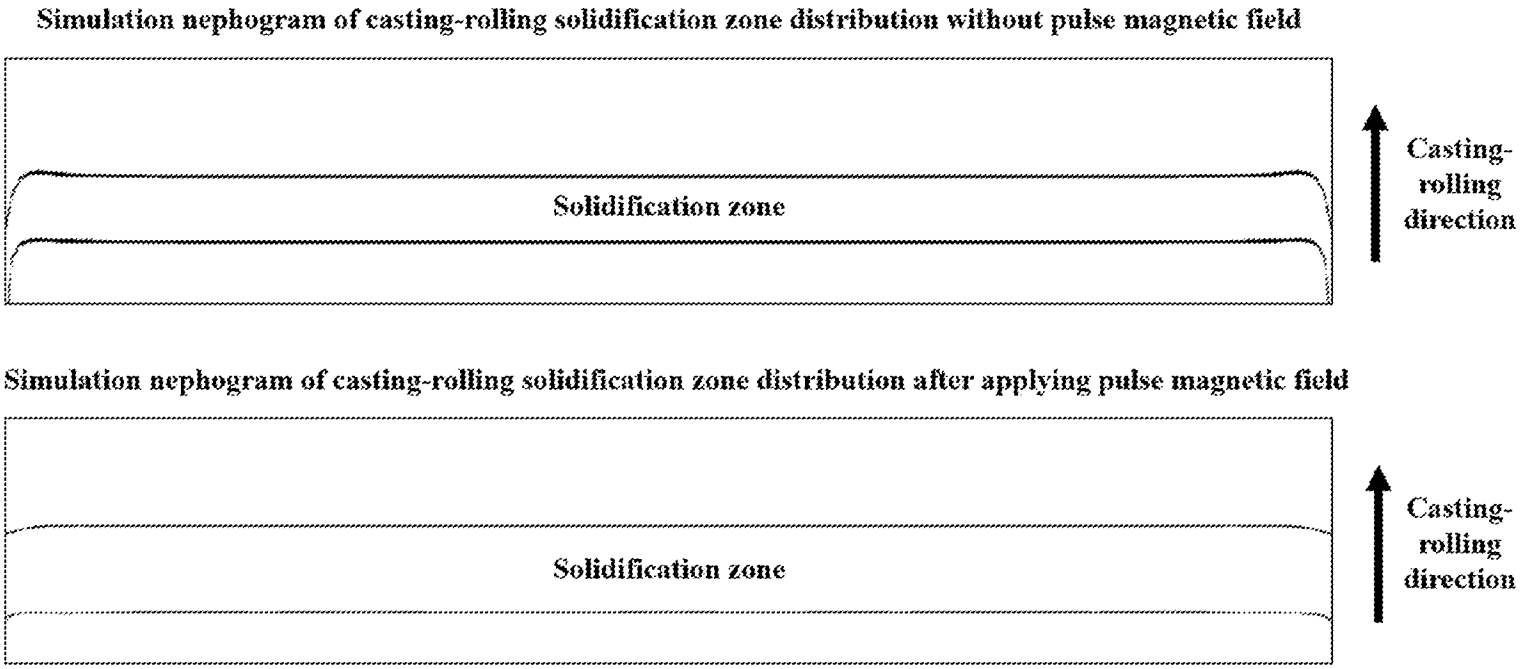
FIG. 10 is a comparison diagram of simulation nephograms of solidification zone distribution.

Metal is poured along the casting-rolling starting end of the pair of casting rolls to form the sprue, the casting rolls rotate to form the casting-rolling zone, and the two sides of the casting-rolling zone are covered by the side sealing plates 1 respectively. The low-frequency pulse generator and the high-frequency pulse generator are started, the first electromagnetic coil 7 releases first low-frequency pulses along the first axis direction from the side ends to the center of the casting-rolling zone, and the second electromagnetic coils 11 release second high-frequency pulses along the second axis direction at the same time. The electromagnetic stirring is formed at the edge of the casting-rolling zone through the first pulse, which promotes the heat exchange in the microstructure and forms the Joule heat effect at the same time. The second axis direction is perpendicular to the first axis direction, so that the repulsive force action is generated between the casting-rolling zone and the side sealing plate 1 which is formed by the Lorentz force, and the viscous effect between the casting-rolling zone and the side sealing plate 1 is reduced. With reference to FIG. 10, it may be seen that the disclosure may greatly reduce the viscous effect between the edge of the casting-rolling zone and the side sealing plate 1, and distribution of a solidification zone depends on temperature distribution, so it also means that the disclosure makes the temperature distribution at the edge of the casting-rolling zone consistent with that in the middle.

In a description of the disclosure, it should be understood that terms "vertical", "horizontal", "up", "down", "front", "back", "left", "right", "vertical", "horizontal", "top", "bottom", "inside", "outside", and other indications of orientation or positional relationships are based on orientation or positional relationships shown in accompanying drawings, solely for a convenience of describing the disclosure, rather than indicating or implying that a device or a component referred to must have a specific orientation, be constructed and operated in a specific orientation, therefore it may not be understood as a limitation of the disclosure.

The above-mentioned embodiments only describe preferred embodiment of the disclosure, and do not limit a scope of the disclosure. Under a premise of not departing from a design spirit of the disclosure, various modifications and improvements made by a person of ordinary skill in the art to the technical scheme of the disclosure shall fall within a protection scope determined by claims of the disclosure.

What is claimed is:

1. A casting-rolling side sealing device with an electromagnetic stirring function, comprising a casting-rolling zone formed by a rotational cooperation a pair of casting rolls, and further comprising:

a pair of side sealing plates configured to cover two side ends of the casting-rolling zone respectively from a casting-rolling starting end to a casting-rolling ending end, wherein a pre-tightening force is formed between one of the side sealing plates and adjacent casting rolls;

a first electromagnetic assembly arranged on each of the side sealing plates, wherein a pulse end of the first electromagnetic assembly releases first pulses along a first axis direction parallel to a direction from the side ends to a center of the casting-rolling zone; the first pulses are configured to generate an electromagnetic stirring effect in the casting-rolling zone, and promote a heat exchange in a microstructure and form a Joule heat effect; and a second electromagnetic assembly arranged on the each of the side sealing plates, wherein a pulse end of the second electromagnetic assembly releases second pulses along a second axis direction perpendicular to the first axis direction, and the second pulses are configured to act on a side edge of the casting-rolling zone to reduce viscous resistance formed by a contact between the each of the side sealing plates and an end face of a solidified microstructure in an adjacent casting-rolling zone;

wherein the first electromagnetic assembly comprises:

a ceramic core cooperatively fixed on a side, opposite to another side contacting the casting rolls, of the each of the side sealing plates;

a first electromagnetic coil wound around the ceramic core and configured to externally connect with a low-frequency pulse generator, wherein the first electromagnetic coil cooperates with the ceramic core to release the first pulses; and an adjusting piece arranged on the each of the side sealing plates, wherein an adjusting end of the adjusting piece is configured to connect with the first electromagnetic coil, and capable of controlling a number of turns of the first electromagnetic coil connected with the low-frequency pulse generator to adjust a magnetic induction line density of the first pulses, so as to accurately control a pulse action end in a mechanical level.

2. The casting-rolling side sealing device with the electromagnetic stirring function according to claim 1, wherein the adjusting piece comprises:

a carbon brush, wherein a groove is formed on one side of the ceramic core close to the casting-rolling starting end, and the carbon brush is slidably fitted in the groove and in sliding contact with the first electromagnetic coil, and one end of the first electromagnetic coil close to the casting rolls is directly connected with the low-frequency pulse generator, and another end of the first electromagnetic coil is connected with the low-frequency pulse generator through the carbon brush; and a driving mechanism arranged on the each of the side sealing plates, wherein a driving end of the driving mechanism is connected with the carbon brush, and the carbon brush is slidably fitted in the groove through the driving mechanism.

3. The casting-rolling side sealing device with the electromagnetic stirring function according to claim 2, wherein the driving mechanism comprises:

a stepping motor fixedly connected to the ceramic core, wherein an output shaft of the stepping motor is connected with a transmission tooth section of a screw through a gear pair, and the screw is fixed in the groove through a bearing, and the carbon brush is in threaded fit with the screw.

4. The casting-rolling side sealing device with the electromagnetic stirring function according to claim 1, wherein the second electromagnetic assembly comprises:

a silicon steel piece fixed on one side, away from the casting rolls, of the each of the side sealing plates; and second electromagnetic coils wound on the silicon steel piece, wherein one end of the second electromagnetic coils is externally connected with a high-voltage high-frequency pulse generator, and the second electromagnetic coils cooperate with the silicon steel piece to release the second pulses.

5. The casting-rolling side sealing device with the electromagnetic stirring function according to claim 4, wherein the silicon steel piece has a U-shaped structure, and the second electromagnetic coils are symmetrically wound around two arms of the silicon steel piece, and a magnetic pole end face of the silicon steel piece is correspondingly placed at a side end face of the casting-rolling zone to ensure that a magnetic pole connection line is parallel to the side end face of the casting-rolling zone in a vertical direction.

6. The casting-rolling side sealing device with the electromagnetic stirring function according to claim 1, wherein the second axis direction is perpendicular to the first axis direction.

7. The casting-rolling side sealing device with the electromagnetic stirring function according to claim 1, wherein one side, away from the casting rolls, of the each of the side sealing plates is fixedly connected with a sealing shell, and the first electromagnetic assembly, the second electromagnetic assembly and the adjusting piece are all arranged in the sealing shell, wherein a heat insulation plate is arranged between the each of the side sealing plates and the sealing shell.

8. The casting-rolling side sealing device with the electromagnetic stirring function according to claim 7, wherein the sealing shell comprises:

a supporting housing fixedly connected to the side, away from the casting rolls, of the each of the side sealing plates, wherein an area of a side end face of the casting-rolling zone is smaller than a projected area of an inner cavity of the supporting housing on the adjacent casting rolls;

a first casting-rolling sealing plate fixedly connected to one side, close to the each of the side sealing plates, of the supporting housing, wherein the heat insulation plate is fixedly connected between the first casting-rolling sealing plate and the each of the side sealing plates; and a second casting-rolling sealing plate fixedly connected to one side, away from the casting rolls, of the supporting housing.

9. The casting-rolling side sealing device with the electromagnetic stirring function according to claim 8, wherein one side, close to the casting-rolling zone, of the first casting-rolling sealing plate, is provided with a caulking groove.

* * * * *